US006397799B1

(12) United States Patent
Carbonne

(10) Patent No.: US 6,397,799 B1
(45) Date of Patent: Jun. 4, 2002

(54) METHOD FOR CONTROLLING A VALVE LIFT DEVICE

(75) Inventor: Laure Carbonne, Toulouse (FR)

(73) Assignee: Siemens VDO Automotive S.A.S., Toulouse-Cedex (FR)

( * ) Notice: Subject to any disclaimer, the term of this patent is extended or adjusted under 35 U.S.C. 154(b) by 0 days.

(21) Appl. No.: 09/701,520

(22) PCT Filed: May 27, 1999

(86) PCT No.: PCT/EP99/03685

§ 371 (c)(1),
(2), (4) Date: Apr. 9, 2001

(87) PCT Pub. No.: WO99/63213

PCT Pub. Date: Dec. 9, 1999

(30) Foreign Application Priority Data

May 29, 1998 (FR) ..... 98 06791

(51) Int. Cl.[7] ..... F01L 1/34

(52) U.S. Cl. ..... 123/90.15; 123/90.17; 123/90.31; 464/2

(58) Field of Search ..... 123/90.15, 90.12, 123/90.16, 90.17, 90.18, 90.31, 198 DB, 692, 361; 464/1, 2, 160

(56) References Cited

U.S. PATENT DOCUMENTS 4,909,194 A 3/1990 Bauer
5,400,747 A * 3/1995 Tabata et al. ..... 123/90.17
5,417,187 A 5/1995 Meyer et al.
5,680,834 A * 10/1997 Szpak et al. ..... 123/90.15
5,937,806 A * 8/1999 Lyko et al. ..... 123/90.15
6,050,250 A * 4/2000 Kerkau ..... 123/692
6,109,225 A * 8/2000 Ogita et al. ..... 123/90.15
6,182,636 B1 * 2/2001 Russell et al. ..... 123/90.17
6,202,610 B1 * 3/2001 Yoshiki et al. ..... 123/90.15
6,213,070 B1 * 4/2001 Hashimoto et al. ..... 123/90.15
6,216,655 B1 * 4/2001 Yoshiki et al. ..... 123/90.15
6,250,283 B1 * 6/2001 Russell et al. ..... 123/361
6,330,869 B1 * 12/2001 Yoshiki et al. ..... 123/90.15
6,332,438 B1 * 12/2001 Machida ..... 123/90.15

FOREIGN PATENT DOCUMENTS

DE 43 17 527 A1 12/1993
EP 0 445 555 A2 9/1991
EP 0 787 892 A1 8/1997

* cited by examiner

*Primary Examiner*—Teresa Walberg
*Assistant Examiner*—Fadi H. Dahbour
(74) *Attorney, Agent, or Firm*—Laurence A. Greenberg; Werner H. Stemer; Ralph E. Locher

(57) ABSTRACT

A method for controlling a valve lift device associated with an internal combustion engine includes determining, according to maps, a relative timing angle to be applied to a camshaft and crankshaft. The determined timing angle is processed with a PID-type control. Each time an engine enters a stabilized low idle speed, a reference value of the timing angle is determined when a valve lift device is inactivated. The reference value is taken into consideration when any later timing angle command is given. At least one further step is included. For example, a map of a duty cycle for an opening of a hydraulic valve controlled by the PID of the valve lift device is pre-established on a test bed as a function of an engine water temperature, and/or the timing angle to be applied as a function of the engine water temperature is adjusted by modifying the reference value.

14 Claims, 1 Drawing Sheet

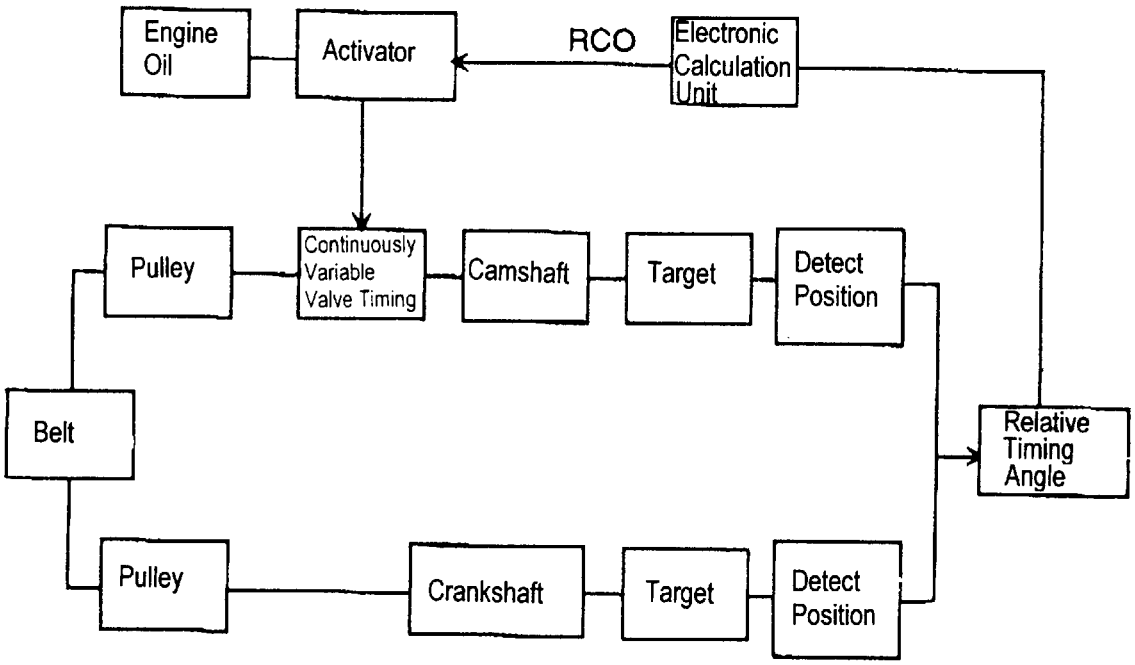
Engine Oil
Activator
RCO
Electronic Calculation Unit
Pulley
Continuously Variable Valve Timing
Camshaft
Target
Detect Position
Belt
Relative Timing Angle
Pulley
Crankshaft
Target
Detect Position

METHOD FOR CONTROLLING A VALVE LIFT DEVICE

BACKGROUND OF THE INVENTION

Field of the Invention

The present invention relates to a method for controlling a valve lift device. A device such as this is employed in particular in internal combustion engines fitted to motor vehicles.

Valve lift devices whose function is to correctly manage the opening and closing of the inlet and exhaust valves mounted on the cylinders of a combustion engine are already known. To do this, these valve lift devices generate a predetermined timing angle between the camshaft and the crankshaft.

Until now, for each type of engine, the set point timing angle to be applied was determined on a test bed as a function of the engine speed, the amount of air let in, and the position of the throttle valve. This set point value was applied via the valve lift device. The actual timing angle between the camshaft and the crankshaft was constantly checked and if the actual timing angle and the set point timing angle did not coincide, a correction was applied.

It soon became apparent that with this method of operation, it was necessary to keep on correcting the relative timing angle of the camshaft and crankshaft. Furthermore, the accuracy and stability of a timing angle set as a set point, and the speed with which this set point value is reached was not satisfactory.

SUMMARY OF THE INVENTION

The purpose of the present invention is to improve the control of the valve lift device and, in particular, to improve its precision, stability and speed.

To this end, the present invention relates to a method for controlling a valve lift device associated with an internal combustion engine, this method being of the type consisting in determining, according to appropriate maps, the relative timing angle to be applied to a camshaft and a crankshaft and in applying this timing angle via a control of the PID type, said method being characterized in that it consists in:

(a) determining the reference value $\alpha_0$ of the timing angle when the valve lift device is inactivated, each time the engine enters stabilized low idle speed, and taking this into consideration when any later timing angle command is given, and in that it comprises at least one of the following steps:

(b) pre-establishing, on the test bed, a map of a duty cycle (RCO) for the opening of a hydraulic valve controlled by the PID of the valve lift device as a function of the engine water temperature, and adjusting the timing angle to be applied (by modifying the reference value $\alpha_0$) as a function of this water temperature, (c) determining the difference between the command (RCO) applied and the command calculated at step (b) by observing the I term of the PID controlling the valve device and storing its value in an adaptive term, (d) determining the response time of the valve lift device following a determined command step and as a function of this response time, modifying the proportional term P of the PID, (e) checking the relative timing angle of the camshaft and the crankshaft does not fluctuate when the set point value is stable, and accordingly modifying the P term of the PID to avoid this fluctuation.

The method according to the invention thus makes it possible, on the one hand, to improve the calculation of the timing angle a to be applied by the valve lift device, and also to correct the P and adaptive terms of the PID controlling this valve lift device. The fact of measuring the value $\alpha_0$ of the angle between the camshaft and the crankshaft, in the absence of any activity of the valve lift device, each time the engine is in a stabilized low idle period, makes it possible to take account of the change in this timing angle throughout a journey, rather than simply upon start-up. This timing angle does actually tend to change with the engine temperature, and capturing it just once at start-up is insufficient.

Furthermore, the method according to the invention also makes it possible to diagnose malfunctionings of the valve lift device in static or dynamic regime. Specifically, the response times of the valve lift device for performing a predetermined command step are measured and analyzed. If these response times are too long, a valve lift device malfunction indicator is activated.

Likewise, a malfunction in static regime is detected when the difference between a set point timing angle and the measured timing angle is greater than a threshold a certain number of times.

Other objects, features and advantages of the present invention will in any case be better understood from reading the description which follows, with reference to the figure of the drawing.

BRIEF DESCRIPTION OF THE DRAWING

The figure is a block circuit diagram depicting a chain of command of a valve lift device and an associated means for measuring a difference in angle according to the invention.

According to the embodiment depicted in FIG. 1, a conventional internal combustion engine (not depicted) has a crankshaft and a camshaft. It will be recalled that the purpose of the crankshaft is to drive the reciprocating movement of a number of pistons each placed inside a cylinder. The function of the camshaft, for its part, is to open and close the inlet and exhaust valves at certain determined moments in the combustion cycle.

In order to be able to set the instant of opening (and of closure) of each of the valves to the optimum instant, it is known practice for the relative timing angle of the camshaft and crankshaft to be varied. This is done by a valve lift device comprising a hydraulic valve. Of course, the precision of the timing angle between the two shafts (camshaft and crankshaft) depends on the precision, stability and speed of this hydraulic valve. In the conventional way, this hydraulic valve is controlled through its opening duty cycle RCO, via an appropriate PID (proportional, integral, derivative) circuit.

According to the embodiment depicted in FIG. 1, the valve lift device (CVVT—Continuously Variable Valve Timing) is controlled by an actuator (a solenoid) receiving, on the one hand, engine oil and, on the other hand, commands (RCO) from a central computer (ECU—Electronic Central Unit). This valve lift device is made up of two parts: one is stationary with respect to the camshaft and the other can move with respect to the camshaft but is stationary with respect to the pulley (and therefore with respect to the crankshaft). An imbalance in the pressures between the two chambers of the valve lift device causes the stationary part to rotate with respect to the moving part and therefore causes the camshaft to rotate through the chosen timing angle with respect to its neutral position (that is to say its position without CVVT) and therefore with respect to the crankshaft.

Targets associated with each of the shafts (camshaft and crankshaft) allow position sensors to detect the position of each of these shafts. The relative timing angle of these shafts is then calculated, from knowledge of the position of each of the shafts.

The measured timing angle is transmitted to the central calculation unit ECU. The central calculation unit compares the measured timing angle with the angle it imposed on the actuator and alters the opening duty cycle RCO of the actuator according to the difference between the measured timing angle and the imposed timing angle.

According to the invention, in order to determine more accurately the timing angle to be imposed on the two shafts, a certain number of additional steps are carried out.

First of all, the position read (that is to say measured by the sensor) in the absence of any action of the valve lift device is stored to serve as reference $\alpha_0$ in subsequent positioning . This position $\alpha_0$ is defined a s being the 0° position.

However, as the engine heats up, the engine temperature changes. Thus, the value of the reference position measured by the sensor (in the absence of any action of the valve lift device) also changes. According to the invention, in order to get around this quite normal drift in the reference timing angle $\alpha_0$, it is measured not only at the start-up but each time the engine enters stabilized low idle speed because when the engine is in such a condition, the action of the valve lift device is minimal if not zero. In this case, the measured timing angle is $\alpha_0$. The reference timing angle is thus constantly updated during a journey.

Furthermore, the measured timing angle is compared with the value it had before. If the difference between the new and old value is a multiple of the value corresponding to a tooth on the pulley, it is considered that there is a breakdown and the range of permissible timing angle values is limited. A vehicle warning indicator (luminous and/or acoustic) is activated to alert the driver as a large difference between two values of the reference position is indicative of incorrect fitting (error in the positioning) of the belt connecting the camshaft to the crankshaft. Hence, when the belt has been removed and then incorrectly positioned when refitted, or if a number of teeth have been jumped on the pulley, the value read by the sensor when the CVVT is at an end-stop position is widely different than the usual value. The difference will be a few degrees of shaft rotation (for example: if it is one tooth out, there is a difference of about 17°). Thus, when the difference between the initial end-stop position and the new end-stop position is more or less a multiple of the value corresponding to one tooth on the pulley, it is diagnosed that there is an error in the positioning of the belt.

Such abnormal positions of the belt, or the jumping of a tooth give rise to a risk of breaking the engine if the CVVT is allowed to adopt extreme positions. In consequence, when such a fault is detected, the range of positions of the CVVT is limited (by limiting the set point values) to avoid any engine breakage. Thus, advantageously, detection of a camshaft position which is inadmissible (because of the incorrect positioning of the belt or the jumping of a tooth) is detected simply by comparing the two consecutive values of the reference position of the CVVT. Of course, in order to be able to detect such an erroneous positioning, it is necessary to store the value of the reference position of the CVVT in non-volatile memory so that it can be used on each start-up.

The method according to the invention also consists in taking account of the imprecisions in control which are due to the variations in current in the actuator. This actuator is generally a solenoid which controls the distribution of oil in the CVVT hydraulic valve.

These variations in current in the actuator are due to variations in resistance brought about by variations in engine water temperature. These variations in current give rise, for one and the same position set point value (that is to say timing angle) that the actuator has to respect, to a different response time. In order to take account of these variations in current, the invention proposes pre-establishing on test bed a map of the RCO of the valve as a function of the engine water temperature.

The object of the invention is to obtain a constant actuator response time (that is to say a constant current in this actuator). Hence, when a drift in current (because the engine water temperature has changed) is detected, this is compensated for for constant current.

Thus, if the current decreases (because of a variation in the water temperature), the RCO is increased. The map produced makes it possible to calculate the correction to be applied to the RCO as a function of the water temperature by adjusting the reference value $\alpha_0$ as a function of this temperature.

Imprecisions in the relative timing angle of the two shafts (camshaft and crankshaft) may also be due to disparities between timing valves. These valves are never strictly identical (for reasons associated with the manufacturing process) and the RCO determined on the test bed for a given engine and a specific valve may differ slightly for another vehicle (even one equipped with the same engine and the same type of valve).

In order to take account of these disparities, the difference $\Delta$ between the command (RCO) applied and the calculated command (from the previously defined map) is measured by observing the I term of the PID controlling the valve device and storing its value in an adaptive term.

The correction applied is calculated in such a way that the I term of the PID tends toward 0 when the position of the valve lift device is stabilized. The $\Delta$ calculated during the journey prior to the stopping of the vehicle can be kept in memory or these values may not be saved and may be recaptured during the first period of low idle following the restarting of the vehicle.

Another source of inaccuracy in the relative timing angle of the two shafts may be due to the oil temperature in the valve and/or to its aging.

These two parameters (temperature and aging) cause disturbances in the response time of the valve lift device. Now, this response time must not be higher than a maximum threshold set by the vehicle manufacturer. For example, this response time must not exceed 500 ms.

In order to determine whether the response time is within its limiting value, the response time of the valve lift device is measured when a command step is imposed on it. The amount of time that the actuator takes to achieve a certain percentage of this command step is measured. For example, the amount of time that the actuator takes to achieve 40 to 70% of this step is measured. According to this partial response time, the value of the proportional term P of the PID is altered.

It will be noted that this command step is not imposed but that the device waits for such a variation to occur during normal operation of the engine so that this partial response time can be measured and the P term altered accordingly.

Another imprecision in the relative timing angle imposed on the two shafts may stem from fluctuations of the valve lift device about a timing angle value. To alleviate this drawback, the timing angle is monitored using two first-order filters so as to detect any fluctuation. If fluctuations are detected, the P term of the PID is altered accordingly.

To improve the precision of the timing angle, it is also possible, when the response time is too long or when fluctuations are detected, to alter, in addition to the P (proportional) term of the PID, the integral (I) and derivative (D) terms of the PID by a multiplicative corrective factor (one corrective factor for the I term and another for the D term).

Each of these steps in improving the precision of the timing angle which are mentioned above can be carried out on its own or in combination with at least one of the other steps. The best precision of this timing angle is, nonetheless, obtained by performing all of these steps together.

The method for controlling a valve lift device according to the present invention also consists in diagnosing any malfunctioning of the valve lift device.

To this end, this diagnosis can be performed in static or dynamic regime.

Diagnosis in static regime is performed when the valve lift device is at a stable set point position. In this case, the difference between the mapped value of the timing angle and the value measured by the sensors (camshaft and crankshaft) is measured. If this difference is greater than a fixed limit value a certain number of times, a valve lift device malfunction indicator is actuated. For example, if, 5 to 10 times, the difference is 0 to 5° crank angle, the malfunction indicator is activated.

Diagnosis in dynamic regime can be carried out at two different moments, namely: during deceleration cutoff or at low idles.

As a preference, this diagnosis is performed during deceleration cutoffs. This is because at that moment (the fuel supply being instantaneously cut off to meet a demand for sharp deceleration), a CVVT position step causes no disturbance in engine speed.

To perform this diagnosis, all that is required is for a set point step to be imposed on the valve lift device. The response time of the valve lift device is then measured and it is checked that this still remains inside the limiting value. If it is, the valve lift device is operating correctly, otherwise, if this limit value is exceeded a certain number of times, then a malfunction indicator is activated.

This command step may also be performed during a period in which the engine is at stabilized low idle. However, in order not to disrupt the engine speed, it is then necessary to compensate for this step by adjusting the ignition advance and/or the injection phase and/or the injection period.

As in the case of deceleration cutoff, the response time of the valve lift device to this step is measured. If this time is below a fixed limit, the valve lift device is operating correctly, otherwise, if this limiting value is exceeded a certain number of times, then a malfunction indicator is activated.

Of course, the present invention is not restricted to the embodiment described and encompasses any variation thereof that is within the competence of those skilled in the art. Thus, these diagnoses are also carried out when the vehicle and the CVVT are in normal operation when a reference step occurs naturally. It is also possible to carry out a speed-of-response diagnosis by observing the rate of travel and comparing it with a minimum threshold.

I claim:

1. A method for controlling a valve lift device associated with an internal combustion engine, which comprises:

determining, according to maps, a relative timing angle to be applied to a camshaft and a crankshaft;

processing the determined timing angle with a PID-type control;

determining, each time an engine enters a stabilized low idle speed, a reference value of the timing angle when a valve lift device is inactivated;

taking the reference value into consideration when any later timing angle command is given; and at least one of:

pre-establishing, on a test bed, a map of a duty cycle for an opening of a hydraulic valve controlled by the PID of the valve lift device as a function of an engine water temperature, and adjusting the timing angle to be applied as a function of the engine water temperature by modifying the reference value;

determining a difference between a timing angle command applied and a command calculated in the pre-establishing step by observing an I term of the PID controlling the valve lift device and storing a value of the I term in an adaptive term;

determining a response time of the valve lift device and modifying a proportional term of the PID as a function of the response time; and determining if the relative timing angle of the camshaft and the crankshaft fluctuates when a set point value is stable, and modifying the proportional term of the PID to avoid a fluctuation if the relative timing angle fluctuates.

2. The method according to claim 1, which further comprises performing the determining a response time step after the determining a difference step.

3. The method according to claim 1, which further comprises performing the determining the reference value step by:

comparing the reference value with an initial reference value; and determining an error to exist in a positioning of a belt connecting the camshaft and the crankshaft when a difference between the reference value and the initial reference value is different than a multiple of a value corresponding to one tooth on a pulley.

4. The control method according to claim 3, which further comprises:

taking account of disparities between valve lift devices using the difference;

determining a second difference between the command applied and the command calculated in the pre-establishing step and storing the second difference in an adaptive term; and calculating an applied correction for making the I term of the PID tend toward 0 when a position of the valve lift device is stabilized.

5. The method according to claim 4, which further comprises determining the second difference only when the valve lift device is in a stable position.

6. The method according to claim 1, which further comprises performing the determining the response time step by not imposing a command step and determining the response time when a command step is performed during driving.

7. The method according to claim 6, which further comprises performing the determining the response time step by setting the determined response time to correspond to a time taken by the valve lift device to perform a given percentage of the command step.

8. The method according to claim 7, wherein the given percentage is between 40 percent and 70 percent of the command step.

9. The method according to claim 1, which further comprises performing the determining a fluctuation step by determining the fluctuation of the valve lift device about a value of the timing angle with a combination of two first-order filters.

10. The method according to claim 1, which further comprises:

diagnosing a correct operation of the valve lift device by comparing the difference with a reference difference; and establishing a valve lift device malfunction when the difference is determined to be greater than the reference difference for a given number of comparisons.

11. The method according to claim 1, which further comprises:

diagnosing a correct operation of the valve lift device by comparing the difference with a reference difference; and establishing a valve lift device malfunction when the difference is determined to be greater than the reference difference for a given number of successive comparisons.

12. The method according to claim 1, which further comprises:

diagnosing a correct operation of the valve lift device by waiting for a fuel supply to be cut off during a deceleration phase and measuring the response time of the valve lift device; and establishing a valve lift device malfunction when the response time is determined to be greater than a predetermined response time for a given number of measurements.

13. The method according to claim 1, which further comprises:

diagnosing a correct operation of the valve lift device by waiting for a fuel supply to be cut off during a deceleration phase and measuring the response time of the valve lift device; and establishing a valve lift device malfunction when the response time is determined to be greater than a predetermined response time for a given number of successive measurements.

14. The method according to claim 1, which further comprises:

diagnosing a correct operation of the valve lift device by bringing about a command step during a stabilized low idle period of a vehicle and compensating for an incorrect operation by adjusting at least one of an ignition advance, an injection phase, and an injection period to avoid any disruption in engine speed;

measuring the response time of the valve lift device to perform the command step; and establishing a valve lift device malfunction when the response time is determined to be greater than a predetermined response time for a given number of measurements.

* * * * *